US008326193B2

(12) United States Patent
Suzuki et al.

(10) Patent No.: US 8,326,193 B2
(45) Date of Patent: Dec. 4, 2012

(54) IMAGE FORMING APPARATUS

(75) Inventors: Masahiro Suzuki, Numazu (JP); Kenichi Iida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 285 days.

(21) Appl. No.: 12/850,221

(22) Filed: Aug. 4, 2010

(65) Prior Publication Data

US 2011/0033212 A1 Feb. 10, 2011

(30) Foreign Application Priority Data

Aug. 5, 2009 (JP) ..... 2009-182918

(51) Int. Cl.
*G03G 15/16* (2006.01)

(52) U.S. Cl. ..... 399/296; 399/45; 399/66; 399/314; 399/315

(58) Field of Classification Search ..... 399/45, 399/66, 99, 296, 314, 315
See application file for complete search history.

(56) References Cited

U.S. PATENT DOCUMENTS

| | | | | |
|---|---|---|---|---|
| 5,623,332 | A * | 4/1997 | Kawaguchi | 399/308 |
| 5,970,296 | A * | 10/1999 | Takase | 399/310 |
| 5,983,041 | A * | 11/1999 | Otaki et al. | 399/45 |
| 6,374,070 | B2 * | 4/2002 | Itoh | 399/128 |
| 6,668,154 | B2 * | 12/2003 | Dickhoff | 399/388 |
| 7,382,992 | B2 * | 6/2008 | Takeda | 399/45 |
| 7,751,765 | B2 * | 7/2010 | Kurosu et al. | 399/313 |
| 7,869,751 | B2 * | 1/2011 | Adachi et al. | 399/316 |
| 8,081,912 | B2 * | 12/2011 | Saito et al. | 399/298 |
| 8,135,319 | B2 * | 3/2012 | Fujita | 399/316 |
| 2003/0113141 | A1 * | 6/2003 | Saito et al. | 399/302 |
| 2003/0123910 | A1 * | 7/2003 | Kim et al. | 399/296 |
| 2005/0025536 | A1 * | 2/2005 | Gross et al. | 399/316 |
| 2007/0048001 | A1 * | 3/2007 | Yamada | 399/99 |
| 2009/0129831 | A1 * | 5/2009 | Sakashita et al. | 399/309 |
| 2009/0202279 | A1 * | 8/2009 | Saito et al. | 399/297 |
| 2009/0214273 | A1 * | 8/2009 | Ue | 399/302 |

FOREIGN PATENT DOCUMENTS

| | | | |
|---|---|---|---|
| JP | 6-138751 | A | 4/1994 |
| JP | 11-161043 | A | 6/1999 |
| JP | 2000-181191 | A | 6/2000 |
| JP | 2004-45457 | A | 2/2004 |
| JP | 2004-333793 | A | 11/2004 |
| JP | 2007185777 | A * | 7/2007 |

* cited by examiner

*Primary Examiner* — David Gray
*Assistant Examiner* — Francis Gray
(74) *Attorney, Agent, or Firm* — Fitzpatrick, Cella, Harper & Scinto

(57) ABSTRACT

An image forming apparatus includes an image bearing member for carrying a toner image; a transfer member forming a nip with the image bearing member to transfer the toner image from the image bearing member onto a transfer material at the nip, wherein the image forming apparatus is operable in a marginless printing mode in which the toner image formed on the image bearing member is larger than a size of the transfer material, and the toner image is transferred as far as edges of the transfer material; and a charging member for effecting electric discharge toward the image bearing member, the charging member being disposed at such a position as is opposed to a side of the transfer material which receives the toner image in an upstream side of the nip with respect to a feeding direction of the transfer material, wherein when the apparatus operates in the marginless printing mode, the charging member effects the electric discharge toward the toner existing in an area of the image bearing member which corresponds to an area which is outside beyond the edge of the transfer material at the nip to electrically charge the toner in the outside area to a polarity opposite a regular polarity.

5 Claims, 5 Drawing Sheets

IMAGE FORMING APPARATUS

FIELD OF THE INVENTION AND RELATED ART

The present invention relates to image forming apparatuses, such as copy machines, printers, etc., which form an image on transfer medium, by electrophotographically forming an image on their image bearing member, transferring the toner image onto transfer medium, and fixing the toner image on the transfer medium.

It has been common practice to leave no less than several millimeters of margin from the edges of a sheet of transfer medium when forming an image with the use of an electrophotographic image forming apparatus. In recent years, demand has been growing stronger for electrophotographic image forming apparatuses capable of forming borderless copies such as conventional silver-salt photographic pictures, because of the diversification of the demands for printers, and also, because of the widespread usage of digital image recording apparatuses such as digital still cameras.

One of the methods for obtaining borderless copies is to form an image on a sheet of transfer medium, which is one size larger than the desired size, and then, trim away the portions of the sheet of transfer medium, which the image does not cover. This method makes it possible to obtain borderless copies with the use of conventional electrophotographic image forming apparatuses without modifying the apparatuses in structure. This method, however, requires an apparatus for cutting away the portions of recording medium, which the image does not cover, after the copies come out of the image forming apparatuses.

Another method for obtaining borderless copies is disclosed in Japanese Laid-open Patent Application 2004-45457. According to this patent application, a desired toner image is formed on a sheet of transfer medium which is smaller than the toner image. This method, however, is problematic in that it soils the back surface of transfer medium. For example, in a case where this method is used with an image forming apparatus of the intermediary transfer type to obtain borderless copies, when a toner image is transferred onto a sheet of transfer medium from the intermediary transfer member of the apparatus, the edge portions of the toner image extend beyond the edges of the sheet of transfer medium. Thus, these portions of the toner image, that is, the portions of the toner image, which extend beyond the edges of the sheet of transfer medium, are transferred onto the second transfer roller of the apparatus. That is, toner adheres to the second transfer roller. As toner adheres to the second transfer roller, it soils the sheet of transfer medium on which the toner image is being transferred, and/or the following sheet of transfer medium as well, across the back surface. In other words, this method has been problematic in that it causes the so-called "back soiling".

SUMMARY OF THE INVENTION

The primary object of the present invention is to prevent toner from adhering to the transferring member of an electrophotographic image forming apparatus, when outputting borderless copies by forming a desired toner image larger than a sheet of transfer medium on which the toner image is to be transferred.

According to an aspect of the present invention, there is provided an image forming apparatus comprising an image bearing member for carrying a toner image; a transfer member forming a nip with said image bearing member to transfer the toner image from said image bearing member onto a transfer material at said nip, wherein said image forming apparatus is operable in a marginless printing mode in which the toner image formed on said image bearing member is larger than a size of the transfer material, and the toner image is transferred as far as edges of the transfer material; and a charging member for effecting electric discharge toward said image bearing member, said charging member being disposed at such a position as is opposed to a side of the transfer material which receives the toner image in an upstream side of said nip with respect to a feeding direction of the transfer material, wherein when said apparatus operates in the marginless printing mode, said charging member effects the electric discharge toward the toner existing in an area of the image bearing member which corresponds to an area which is outside beyond the edge of the transfer material at the nip to electrically charge the toner in the outside area to a polarity opposite a regular polarity.

These and other objects, features, and advantages of the present invention will become more apparent upon consideration of the following description of the preferred embodiments of the present invention, taken in conjunction with the accompanying drawings.

BRIEF DESCRIPTION OF DRAWINGS

FIG. 4(*b*) is a schematic drawing of the toner image charging member of the image forming apparatus in the first embodiment of the present invention, and shows the shape of the pointed teeth portion of toner image charging member.

DESCRIPTION OF THE PREFERRED EMBODIMENTS

Hereinafter, the image forming apparatuses in accordance with the present invention will be described in more detail with reference to the appended drawings.

Embodiment 1

1. Structure of Image Forming Apparatus

Figure 1:
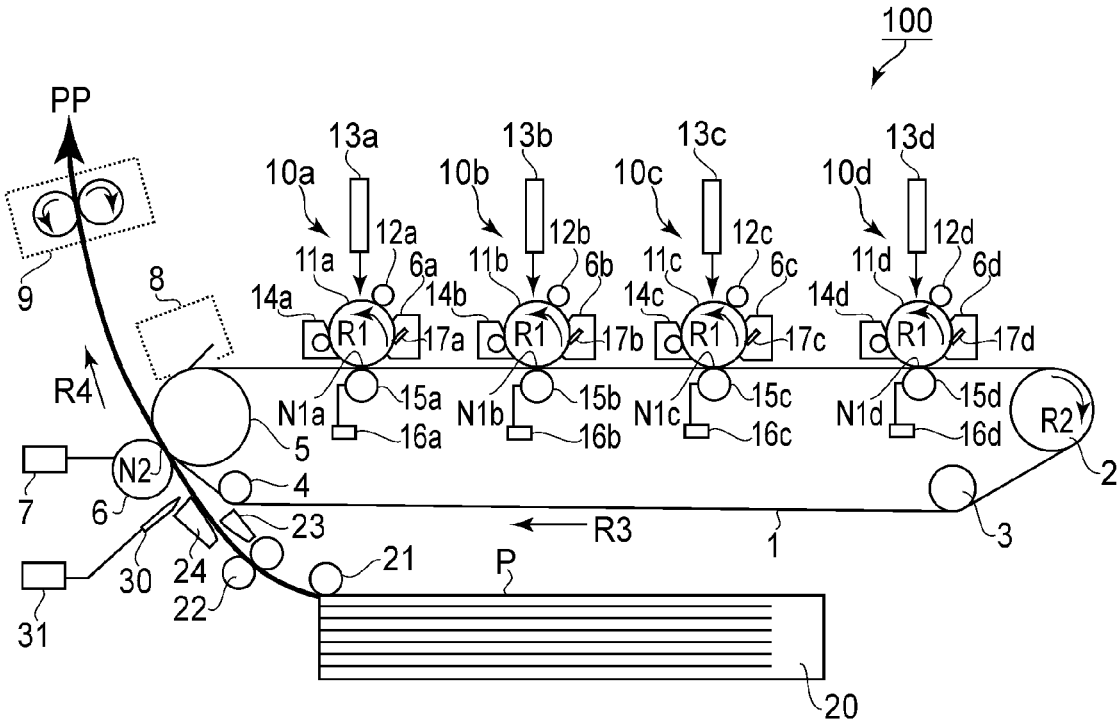
FIG. 1 is a vertical sectional view of the image forming apparatus in the first preferred embodiment of the present invention, and shows the structure of the apparatus.

FIG. 1 is a vertical sectional view of the image forming apparatus in the first preferred embodiment of the present invention, and shows the structure of the apparatus. The image forming apparatus 100 in this embodiment is an image forming apparatus of the intermediary transfer type.

The image forming apparatus 100 has four image forming portions which are different in the color in which they form images, more specifically, the four image forming portions which form yellow, magenta, cyan, and black monochromatic images 10*a*-10*d*, one for one. The image forming portions 10*a*-10*d* are in the form of an independent unit.

In this embodiment, the image forming portions 10*a*-10*d* are virtually the same in structure, although they are different in the color of the toner they use. Thus, unless necessary, the suffixes a, b, c, and d of the referential codes for various portions of the apparatus, which indicates the four colors, one for one, will not be shown.

Each image forming portion 10 has a photosensitive drum 11, which is rotatable in the direction (counterclockwise direction) indicated by an arrow mark in the drawing. The photosensitive drum 11 is made up of a metallic cylinder and a photoconductive layer. The photoconductive layer covers the entirety of the peripheral surface of the metallic cylinder.

The image forming portion 10 has a charge roller 12 for uniformly charging the peripheral surface of the photosensitive drum 11. The charge roller 12 is disposed in the adjacencies of the peripheral surface of the photosensitive drum 11. The image forming portion 10 has a laser scanner 13 as an exposing unit which scans the peripheral surface of the photosensitive drum 11 with a beam of laser light while modulating the beam of laser light according to the information of an image to be formed (image formation signals). The laser scanner 13 is on the downstream side of the charge roller 12 in terms of the rotational direction R1 of the photosensitive drum 11. The charged portion of the peripheral surface of the photosensitive drum 11 is exposed by the laser scanner 13, whereby an electrostatic latent image (electrostatic image) is formed on the peripheral surface of the photosensitive drum 11. The image forming portion 10 also has a developing device 14 as a development unit which develops the electrostatic latent image into a visible image, that is, an image formed of toner (which hereafter will be referred to simply as toner image). The developing device 14 is on the downstream side of the laser scanner 13 in terms of the rotational direction R1 of the photosensitive drum 11. The developing devices 14*a*-14*b* contain four toners, one for one, the color of which corresponds to the monochromatic images, which the four image forming portions form, one for one. The toner image developed by the developing device 14 remains on the peripheral surface of the photosensitive drum 11 until the next image formation step starts.

The image forming portion 10 has also a first transfer roller 15 as a toner image transferring first member, which is positioned in contact with the inward surface of an intermediary transfer belt 1 in such a manner that it opposes the photosensitive drum 11 with the presence of the intermediary transfer belt 1 between the peripheral surface of the photosensitive drum 11 and the peripheral surface of the first transfer roller 15. The first transfer roller 15 is pressed against the photosensitive drum 11 through the intermediary transfer belt 1, forming thereby the first transfer nip N1 (image transferring first portion). The first transfer roller 15 is connected to an electric power source 16 as an electrical voltage applying means for the first transfer, in such a manner that the first transfer voltage to be applied to the first transfer roller 15 can be varied in magnitude. The first transfer voltage power sources 16*a*- 16*d* are independent from each other so that they can apply the first transfer voltage to the transfer rollers 15*a*-15*d*, respectively. The image forming portion 10 has also a drum cleaner 17 as a photosensitive member cleaning means, which is on the downstream side of the first transfer nip N1, in terms of the rotational direction R1 of the photosensitive drum 11, to remove the toner (transfer residual toner) remaining on the peripheral surface of the photosensitive drum 11 after the first toner image transfer.

The intermediary transfer belt 1, which is an intermediary transferring member, is an endless belt. It is supported and kept stretched by four rollers as belt supporting members, more specifically, a driver roller 2, a tension roller 3, an auxiliary roller 4, and second transfer roller 5. The intermediary transfer belt 1 is in contact with each of the photosensitive drums 11*a*-11*d*. The intermediary transfer belt 1 in this embodiment is an endless non-laminar belt made of PvdF resin, which was adjusted in volume resistivity to roughly $10^{10}$ Ω·m with the addition of ion-conductive agent. It is 100 μm in thickness. From the standpoint of providing an image forming apparatus, which is low in cost because it does not require a means for removing residual charge from its intermediary transfer belt after the second transfer, the intermediary transfer belt 1 is desired to be in a range of $10^8$ Ω·m-$10^{11}$ Ω·m in volume resistivity. The intermediary transfer belt 1 is an image bearing member onto which toner images are transferred from photosensitive drums 11.

All of the four rollers 2, 3, 4, and 5, by which the intermediary transfer belt 1 is suspended and kept stretched, are grounded.

The driver roller 2 circularly moves the intermediary transfer belt 1 in the direction R3 (clockwise direction) indicated by an arrow mark, by being rotated in the direction R2 (clockwise direction). The driving roller 2 in this embodiment is a rubber roller made up of a metallic core made of aluminum, and a rubber layer wrapped around the metallic core. The rubber layer is made of EPDM rubber in which carbon particles were dispersed as electrically conductive agent. The rubber layer is 0.5 mm in thickness, no more than $10^5$ Ω·m in electrical resistance, and 24 mm in external diameter.

In order to provide the intermediary transfer belt 1 with a consistent amount of tension, the tension roller 3 is kept under the pressure supplied by springs (unshown) as pressure applying means. The tension roller 3 in this embodiment is a metallic roller made of aluminum, and is 16 mm in external diameter.

The auxiliary roller 4 is on the upstream side of the second transfer nip N2 (which will be described later in detail) in terms of the transfer medium conveyance direction R4. It is provided to position the intermediary transfer belt 1 so that the intermediary transfer belt 1 moves along the path through which the transfer medium P is conveyed. In this embodiment, a metallic roller which is made up SUS (stainless steel) and 10 mm in external diameter was used as the auxiliary roller 4.

The image forming apparatus 100 is provided with a second transfer roller 6 as a toner image transferring second member, and a belt cleaner 8 as an intermediary transfer belt cleaning means. The second transfer roller 6 and belt cleaner 8 are positioned in contact with the intermediary transfer belt 1, in such a manner that they oppose a backup roller 5 (for backing up intermediary transfer belt against second transfer roller 6) across the intermediary transfer belt 1. The second transfer roller 6 forms a nip by being placed in contact with the intermediary transfer belt 1. It is a toner image transferring member which transfers the toner image on the intermediary transfer belt 1 onto the transfer medium P while the transfer medium P is conveyed through the nip by being pinched by the second transfer roller 6 and intermediary transfer belt 1. In this embodiment, a rubber roller made of a metallic core made of aluminum, and a rubber layer wrapped around the metallic core, was used as the backup roller 5 which opposes the second transfer roller 6. The rubber roller is made of EPDM rubber in which carbon particles were dispersed as electrically conductive agent. It is 0.5 mm in thickness, no more than $10^5$ Ω·m in electrical resistance, and 24 mm in external diameter.

The second transfer roller 6 forms the second transfer nip N2 (toner image transferring second portion), by being pressed against the backup roller 5 through the intermediary transfer belt 1. The second transfer roller 6 is in connection with a second transfer voltage power source 7 as an electrical voltage applying means, in such a manner that second transfer voltage to be applied to the second transfer roller 6 can be varied in magnitude. In this embodiment, an elastic roller made up of a metallic core made of SUS, and an elastic layer wrapped around the metallic core, was used as the second transfer roller 6. The elastic roller is made of electrically conductive foamed rubber. It is 30 degrees in hardness (4.9 N (500 gf) under load, in Asker-C), $1\times10^7$ Ω·m in electrical resistance, and 18 mm in external diameter.

There is a toner image charging member 30 (which will be described later in detail) on the upstream side of the second transfer nip N2 in terms of the transfer medium conveyance direction R4, being positioned so that it will be on the non-transfer surface side of the transfer medium P when the transfer medium P is conveyed through a transfer medium conveyance path PP.

Incidentally, the non-transfer surface of the transfer medium P means the opposite surface of the transfer medium P from the surface of the transfer medium P onto which a toner image is going to be transferred in the transfer portion to which the transfer medium P is being conveyed. The transfer surface of the transfer medium P means the surface of the transfer medium P, onto which a toner image is going to be transferred in the transfer portion to which the transfer medium P is being conveyed through the transfer medium conveyance path PP.

The charging member 30 is in connection with a charge voltage power source 31 as an electrical voltage applying means, in such a manner that the voltage to be applied to the transfer medium P and the toner image on the intermediary transfer belt 1 can be varied in magnitude. The charging member 30 and charge voltage power source 31 will be described later in detail. There are top and bottom guides 23 and 24, respectively, for guiding the transfer medium P, on the upstream side of the charging member 30 in terms of the transfer medium conveyance direction R4. The top and bottom guides 23 and 24 are for guiding the transfer medium P to the second transfer nip N2, and also, for regulating the transfer medium P in position while the transfer medium P is conveyed through the transfer medium conveyance path PP.

2. Image Forming Operation

Next, the gist of the image forming operation of the image forming apparatus 100 in this embodiment will be described. The photosensitive drum 11 of the image forming portion 10 is rotated in the direction R1 indicated by the arrow mark in the drawing. As it is rotated, its peripheral surface is uniformly charged by the charge roller 12 to the same polarity as toner. The normal polarity to which toner is charged in this embodiment is negative. Thus, the peripheral surface of the photosensitive drum 11 is charged to the negative polarity.

Next, the photosensitive drum 11 is exposed by the laser scanner 13 according to the information of the image to be formed. As the peripheral surface of the photosensitive drum 11 is exposed, an electrostatic latent image, which corresponds in pattern to the monochromatic image to be formed by the image forming portion P, is formed on the peripheral surface of the photosensitive drum 11. This electrostatic latent image is developed by the developing device 14, which uses negatively charged toner. That is, the electrostatic latent image is developed into a visible image, that is, an image formed of toner.

The toner image is transferred (first transfer) onto the intermediary transfer belt 1 by the first transfer roller 15 to which positive voltage, that is, voltage opposite in polarity from the toner voltage, is being applied from the first transfer voltage power source 16. After the first transfer of the toner image, the peripheral surface of the photosensitive drum 11 is cleaned by the drum cleaner 17 so that it can be used for the next round of image formation; the toner remaining on the peripheral surface of the peripheral surface of the photosensitive drum 11*a* is removed by the drum cleaner 17.

For example, when the image forming apparatus 100 is used for forming full-color images, the sequence made up of the above described charging, exposing, developing, transferring (first transfer), and cleaning processes is carried out in each of the image forming portions 10*a*-10*d*, whereby four monochromatic toner images, different in color, are layered on the intermediary transfer belt 1.

Meanwhile, one of the multiple transfer mediums P stored in layers in a transfer medium cassette 20 is picked up, and conveyed to a pair of registration rollers 22, by a feed roller 21. Then, the transfer medium P is conveyed to the second transfer nip N2 by the pair of registration rollers 22 in synchronism with the arrival of the toner images on the intermediary transfer belt 1 at the second transfer nip N2.

In the second transfer nip N2, the toner images on the intermediary transfer belt 1 are transferred all at once (second transfer) onto the transfer medium P by the second transfer roller 6, to which positive voltage, that is, voltage opposite in polarity from the toner voltage, is being applied from the second transfer voltage power source 7. The transfer residual toner, that is, the toner which failed to be transferred onto the transfer medium P and is remaining on the intermediary transfer belt 1 after the second transfer, is removed by the belt cleaner 8.

After being conveyed through the second transfer nip N2, the transfer medium P, which bears the toner images at this point in the image forming operation, is conveyed to a fixing device 9, in which it is subjected to heat and pressure, becoming thereby fixed to the transfer medium P. Then, the transfer medium P is discharged from the fixing device 9, and is discharged into a delivery tray (unshown), ending the image formation sequence.

3. Normal Printing Mode and Borderless Printing Mode

The image forming apparatus 100 in this embodiment can be operated in the first and second printing modes. The first printing mode is the normal printing mode for outputting normal copies, that is, copies with margins, whereas the second printing mode is the printing mode for outputting borderless copies. Here, a bordered copy means a copy, the image on which leaves a preset amount of margins along the four edges of the transfer medium P. In other words, in the normal printing mode, the image forming apparatus 100 outputs copies having four narrow areas, which are not covered with the toner image, along the four edges of the transfer medium P.

In comparison, the borderless image formation means the image forming operation for outputting copies, the image on which covers the transfer medium P all the way to at least one of the four edges, that is, the front, rear, left, and right edges, of the transfer medium P.

Incidentally, when the transfer medium P is positioned so that its downstream edge, in terms of the transfer medium conveyance direction R4, is at the top, the leading, trailing, left, and right edges of the transfer medium P are the top, bottom, left, and right edges of the transfer medium P.

The image forming apparatus 100 in this embodiment is provided with a masking function which makes it possible to control the laser scanner 13 in terms of the area of the peripheral surface of the photosensitive drum 11, across which the laser scanner 13 can expose, according to each of the printing modes described above, and also, according to transfer medium size.

Figure 2:
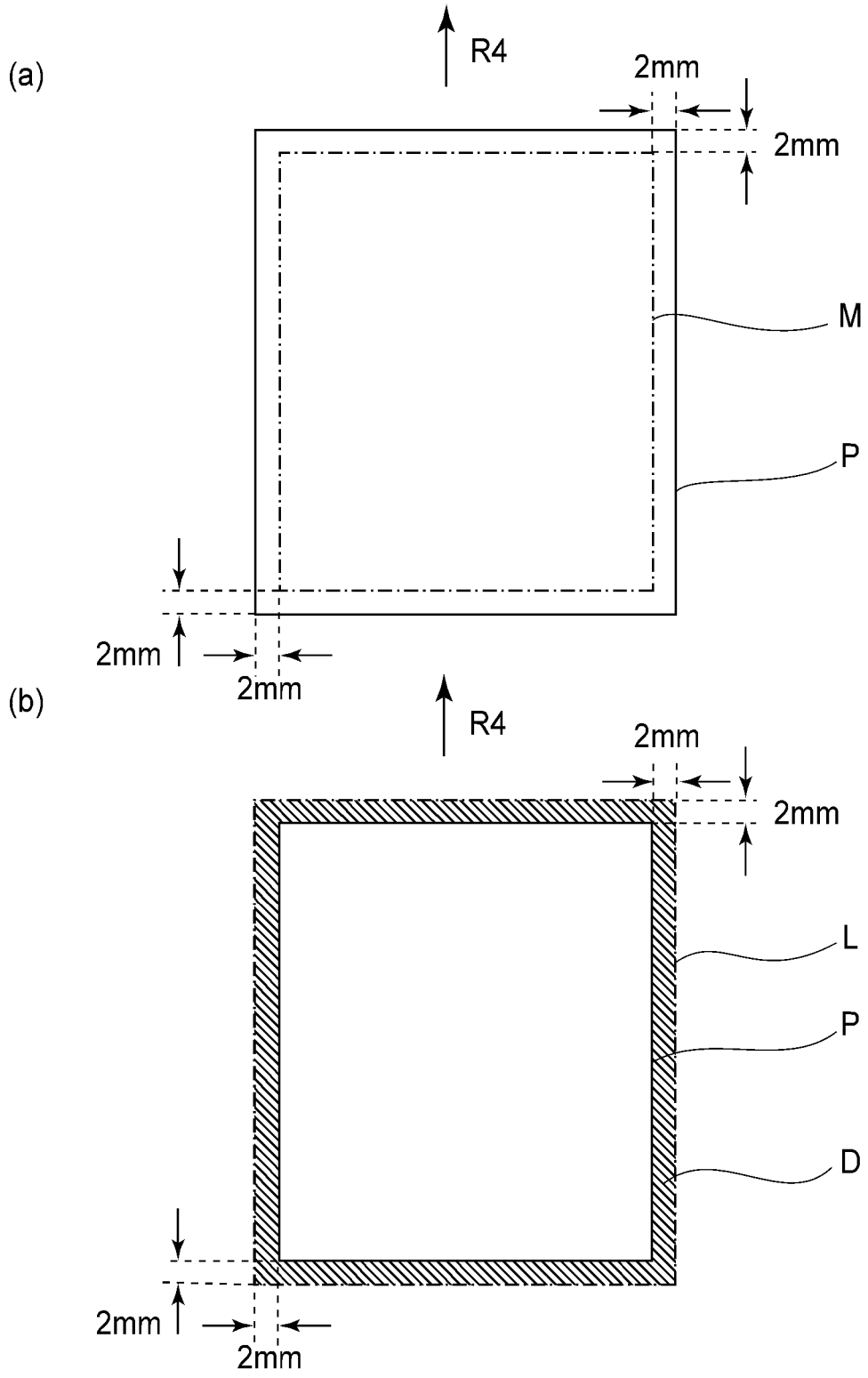
FIG. 2 is a schematic drawing for showing the relationship in size between the toner image and transfer medium.

Shown in FIG. 2(*a*) are margin portions of the transfer medium P, which correspond to the areas of the peripheral surface of the photosensitive drum 11, which are not exposed by the laser scanner 13 when the image forming apparatus 100 in this embodiment is in the normal printing mode. In this embodiment, the areas of the photosensitive drum 11, which are not exposed correspond to the area of the transfer medium P, which is outside the area surrounded by a dotted line M which is 2 mm inward of the leading, trailing, left, and right edges of the transfer medium P. That is, the area of the transfer medium P surrounded by the dotted line M is the area in which an image is formable. As described above, the area of the transfer medium P, across which an image can be formed is smaller than the transfer medium P. That is, when the image forming apparatus 100 is in the normal printing mode, a blank space which is no less than 2 mm in width is left along the four edges of the transfer medium P.

Shown in FIG. 2(*b*) is the area of the peripheral surface of the photosensitive drum 11, which is exposed when the image forming apparatus 100 is in the borderless printing mode. In this embodiment, the area of the peripheral surface of the photosensitive drum 11, which is exposed in the borderless printing mode corresponds to the area in FIG. 2(*b*), which is surrounded by a dotted line L, which is 2 mm outward of the leading, trailing, left, and right edges of the transfer medium P. That is, the area in FIG. 2(*b*), which is surrounded by this dotted line L is the area on which an image can be formed. In other words, when the image forming apparatus 100 in this embodiment is in the borderless printing mode, the area in FIG. 2(*b*), which is surrounded by the dotted line L, is the area on which an image can be formed. As will be evident from the description given above, when the image forming apparatus 100 is in the borderless printing mode, there is an area D, which extends as far as 2 mm beyond the leading, trailing, left, and right edges of the transfer medium P.

Therefore, in the borderless printing mode, a toner image which is larger than the transfer medium P is formed on the photosensitive drum 11, and then is transferred (first transfer) onto the intermediary transfer belt 1. In the second transfer nip N2, the toner image, which is larger than the transfer medium P, is transferred onto the transfer medium P from the intermediary transfer belt 1. The provision of the structural setup such as the one described above ensures that even if the toner image on the intermediary transfer belt 1 and the transfer medium P become slightly misaligned with each other during the second transfer, the transfer medium P will be covered with the toner image from edge to edge, and corner to corner, as long as the amount of misalignment falls within a range in which the toner image does not transfer beyond the area D. As the causes of the slight misalignment between the image on the intermediary transfer belt 1 with the transfer medium P is thought to be that the transfer medium P is incorrect in measurement, and/or that the transfer medium P becomes deviated in position before it reaches the second transfer nip N.

4. Soiling of Backside of Transfer Medium in Borderless Printing Mode

The portion of the toner image, which is on the area D, that is, the portion of the toner image, which was transferred onto the portion of the intermediary transfer belt 1, which corresponds to the area D in FIG. 2(*b*), is transferred from the intermediary transfer belt 1 onto the second transfer roller 6. Therefore, it is possible that the toner having transferred (adhered) to the second transfer roller 6 adheres to the back side of the transfer medium P after the first rotation, and the rotations thereafter, of the second transfer roller 6 after the second transfer. In this specification, the soiling of the back side of the transfer medium P, which is attributable to the toner having adhered to the second transfer roller 6, will be referred to simply as "back soiling".

The portion of the toner image, which was extending beyond the trailing edge of the transfer medium P, soils the second transfer medium P and the transfer mediums P thereafter, on the back side. Incidentally, the back soiling of the second transfer medium P and the transfer mediums P thereafter occurs also when the second transfer medium P and the mediums P thereafter become misaligned with the first transfer medium P in the left or right direction.

One of the methods for preventing the "back soiling" is to provide an image forming apparatus (100) with a cleaning means, such as a blade or a fur brush, which mechanically or electrostatically removes the toner on the second transfer roller 6. Providing an image forming apparatus with a cleaning means such as the abovementioned ones makes the image forming apparatus larger or complicated. Further, it requires to provide the image forming apparatus with a toner recovery box or the like, which also makes the apparatus larger. In other words, the provision of a cleaning apparatus leads to the increase in image formation apparatus cost. Further, the second transfer roller 6 has to be frequently cleaned, which in turn is likely to reduce the image forming apparatus in productivity.

5. Structure of Charging Member

Thus, in this embodiment, the charging member 30 which is the charging member for charging the toner image on the intermediary transfer belt 1 is positioned on the upstream side of the second transfer nip N2 in terms of the transfer medium conveyance direction R4. As voltage is applied to the charging member 30, the charging member 30 induces electrical discharge between itself and intermediary transfer belt 1, whereby it charges the toner image.

Figure 3:
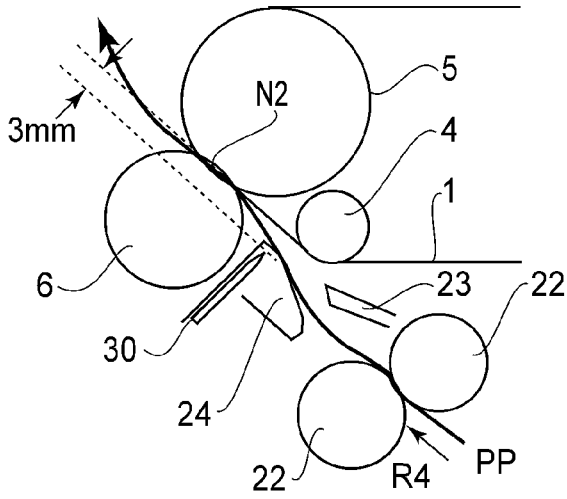
FIG. 3 is a vertical sectional view of the second transfer nip, and its adjacencies, of the image forming apparatus in the first embodiment, and shows the structure of the second transfer nip and its adjacencies.

FIG. 3 is a vertical sectional view of the second transfer nip N2, and its adjacencies, of the image forming apparatus in this embodiment, and shows the structure of the second transfer nip and its adjacencies.

The charging member 30 has to be able to charge the toner image on the intermediary transfer belt 1 from the non-transfer surface side of the transfer medium P before the second transfer occurs. Therefore, the charging member 30 is placed on the non-transfer surface side of the transfer medium conveyance path PP relative to the transfer medium P. That is, the charging member 30 is positioned on the opposite side of the transfer medium conveyance path PP from the surface of the transfer medium P, onto which the toner image is transferred. Further, in terms of the transfer medium conveyance direction R4, the charging member 30 is positioned in a range which is on the downstream side of the auxiliary roller 4, and on the upstream side of the second transfer nip N2. This placement of the charging member 30 makes the charging member 30 oppose the intermediary transfer belt 1.

Further, in order to provide an area in which the intermediary transfer belt 1 is placed very close, and in parallel, to the transfer medium P, the auxiliary roller 4 is positioned as close as possible to the transfer medium conveyance path PP. For the purpose of making this embodiment as effective as possible, the distance between the intermediary transfer belt 1 and transfer medium conveyance path PP is desired to be as small as possible as will be described later.

Further, in order to minimize in magnitude, the voltage applied to the charging member 30 to induce the electric discharge from the charging member 30, the distance between the charging member 30 and intermediary transfer belt 1 is desired to be as small as possible. In this embodiment, therefore, the charging member 30 is positioned so that the minimum distance from its charging tips to the intermediary transfer belt 1 becomes 3 mm.

Figure 4:
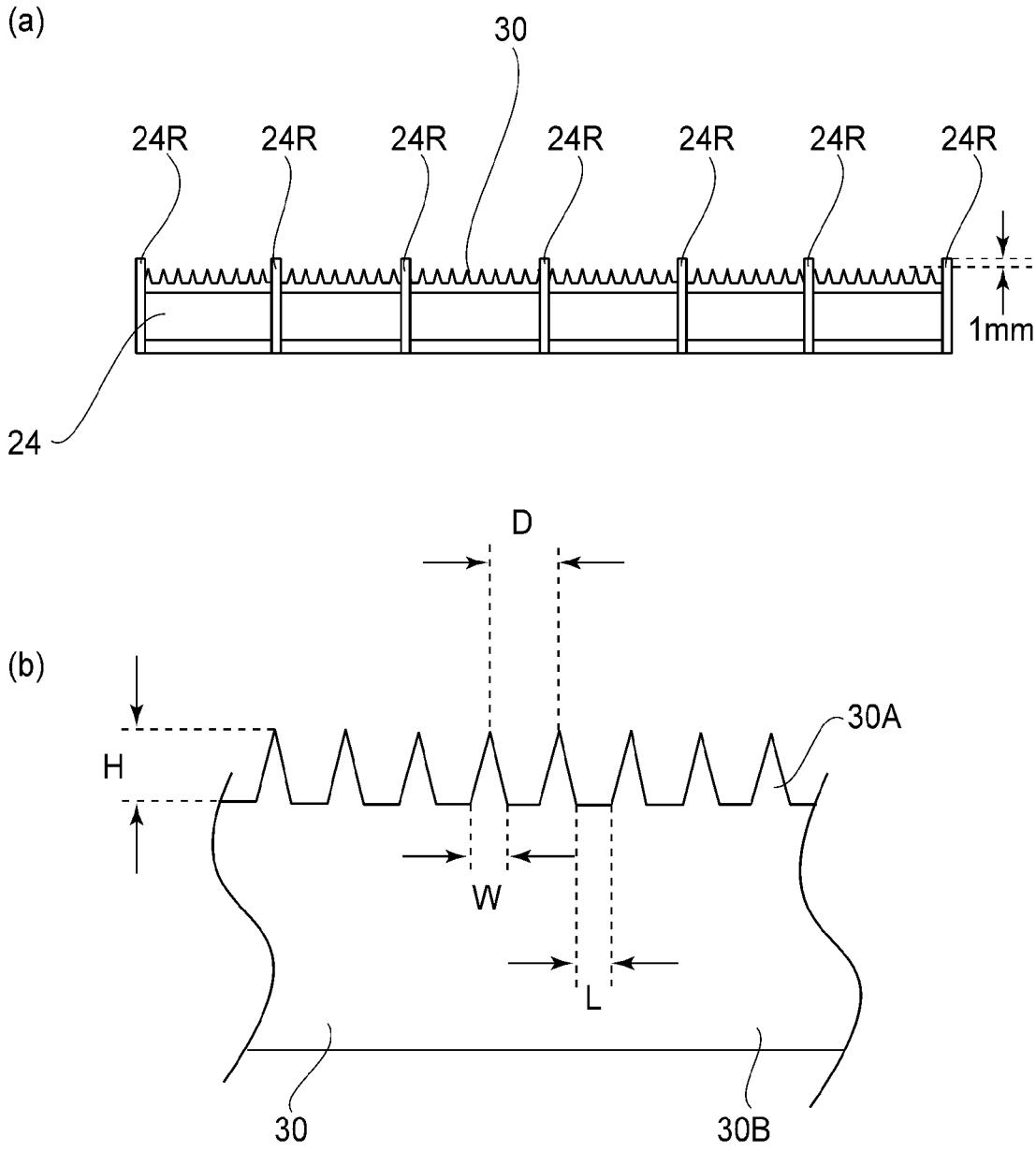
FIG. 4(*a*) is a schematic front view of the transfer medium guide of the image forming apparatus in the first embodiment of the present invention, which is on the upstream side of the second transfer nip of the apparatus, and on the bottom side of the transfer medium passage of the apparatus.

FIG. 4(*a*) is a schematic view of the transfer medium guiding member 24, which is on the bottom side of the transfer medium path PP, and on the upstream side of the second transfer nip N2 in terms of the transfer medium conveyance direction R4. Hereafter, the transfer medium guiding bottom member 24 will be referred to simply as the bottom guide 24, because of its positioning. In order to keep a preset distance between the charging member 30 and transfer medium P, the image forming apparatus 100 is structured so that the transfer medium P is supported by the bottom guide 24. The bottom guide 24 is provided with multiple ribs 24R which control the transfer medium P in position, in terms of the direction perpendicular to the transfer medium surface, by coming into contact with the transfer medium P while the transfer medium P is conveyed from the pair of registration rollers 22 to the second transfer nip N2. In order to keep stable the distance between the charging tips of the charging member 30 and the transfer medium P, the charging member 30 is positioned so that its tips will be positioned slightly lower than the top edge of each rib 24R. In this embodiment, the distance in height between the charging tip of the charging member 30 and the top edge of the rib 24R is 1 mm.

Before the transfer medium P enters the second transfer nip N2, not only is the transfer medium P controlled in position by the bottom guide 24, but also, by a transfer medium guiding member 23, which is on the upstream side of the second transfer nip N2 and on the top side of the transfer medium conveyance path PP, so that the distance between the transfer medium P and intermediary transfer belt 1 also remains stable. Hereafter, the transfer medium guiding member 23 will be referred to simply as the "top guide 23" because of its position relative to the transfer medium conveyance path PP.

The charging member 30 is in connection with the electric power source 31 which can apply to the charging member 30 such voltage that is opposite in polarity to the toner voltage. In this embodiment, the electric power source 31 is enabled to be turned on or off according to the printing mode in which the image forming apparatus 100 is, so that in the normal printing mode, no voltage is applied to the charging member 30, whereas in the borderless printing mode, voltage is applied to the charging member 30. In other words, in the borderless printing mode, the charging member 30 is activated, whereas in the normal mode, the charging member 30 is not activated. In this embodiment, in the borderless printing mode, voltage (pre-second transfer voltage), which is opposite in polarity to the toner voltage, is applied to the charging member 30 from the electric power source 31, as will be described later in detail.

In this embodiment, an electric power source capable of applying the maximum voltage of roughly 5 kV to the charging member 30 was employed as the electric power source for applying voltage to the charging member 30. As high voltage is applied to the charging member 30, corona is discharged between the intermediary transfer belt 1 and auxiliary roller 4, which act as opposing electrodes, whereby the transfer medium P, and the portions of the toner image on the intermediary transfer belt 1, which are outside the boundary of the transfer medium P, are charged by the corona. In this embodiment, the amount of voltage applied to the charging member 30 when the image forming apparatus 100 is in an environment which is 25° C. in temperature and 50% in relative humidity is roughly 3.8 kV. The amount of electric current supplied to the charging member 30 as roughly 3.8 kV of voltage is applied to the charging member 30 was roughly 19 μA.

In this embodiment, a CPU which is the computation controlling means of the control portion of the image forming apparatus 100 integrally controls the operation of the image forming apparatus 100 according to the programs, data, etc., stored in the memories as recording means. The operation of the electric power source 31 described above also is controlled by this CPU of the control portion.

FIG. 4(*b*) is a schematic drawing of the charging member 30, that is, the charging member for charging the portions of the toner image on the intermediary transfer belt 1, which are outside the boundary of the transfer medium P, immediately before the transfer medium P enters the second transfer nip N2. It shows the shape of the charging member 30. In this embodiment, the charging member 30 is formed of a piece of plate made of SUS which is 0.1 mm in thickness. As is evident from the drawing, the charging member 30 in this embodiment has a rectangular base portion 30B, and multiple sharply pointed triangular projections 30A (needles) projecting from one of the long edges of the base portion 30B with preset intervals. This charging member 30 is positioned so that its lengthwise direction is perpendicular (roughly perpendicular in this embodiment) to the transfer medium conveyance path PP, with the tip of each sharply pointed portion 30A pointing to the transfer medium conveyance path PP. Further, in order to ensure that the charging member 30 is efficient in performance, and also, to prevent the portions of the toner images on the intermediary transfer belt 1, which are outside the boundary of the transfer medium P, from becoming nonuniformly charged because of the intervals among the multiple sharply pointed projections 30A, the charging member 30 was made to be 2 mm in the distance D between the tips of the adjacent two sharply pointed projections 30A, 2 mm in the height H of each of the sharply pointed projections 30A, 1 mm in the width W of the bottom portion of each of the sharply pointed projections 30A, and 1 mm in the distance between the bottoms of the adjacent two pointed projections 30A. The charging member 30 in this embodiment is made up of a single long piece of plate. However, it may be made up of two or more pieces. Further, the charging member 30 in this embodiment is long enough to be able to charge even a largest toner image which is completely transferable (including portions of toner image, which extend beyond edges of transfer medium edges) onto the intermediary transfer belt 1, in terms of the direction roughly perpendicular to the transfer medium conveyance direction R4. That is, when the image forming apparatus 100 in this embodiment is in the borderless printing mode, the charging member 30 in this embodiment is capable of charging the toner particles transferred onto the intermediary transfer belt 1, across the areas which will be outside the boundary of the transfer medium P, even if the transfer medium P is the largest transfer medium usable with the image forming apparatus 100.

In this embodiment, the charging member 30 to which voltage can be applied was used as the toner image charging means. However, this embodiment is not intended to limit the present invention in scope. For example, a charging device of the corona type may be employed as the pre-transfer toner image charging means. The reason why the charging member 30 is used as the pre-second transfer toner image charging means in this embodiment is that using the charging member 30 can reduce the charging means in size, which in turn makes it possible to place the charging means very close to the transfer medium P and intermediary transfer belt 1 even in a case where the space in the adjacencies of the second transfer nip N2 is very small.

6. Mechanism of Soiling Prevention by Charging Member

Figure 5:
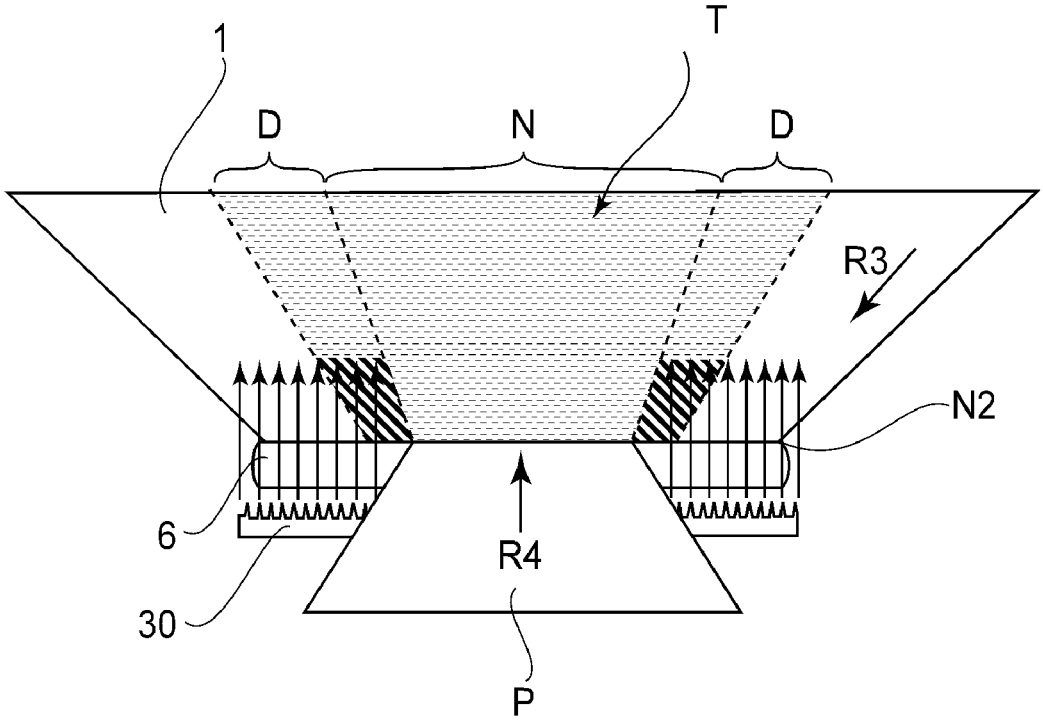
FIG. 5 is a schematic drawing of the second transfer nip of the image forming apparatus in the first embodiment of the present invention, as seen from the upstream side of the nip in terms of transfer medium conveyance direction.

FIG. 5 is a schematic view of the second transfer nip N2 of the image forming apparatus 100 in the first embodiment of the present invention, as seen from the upstream side of the second transfer nip N2 in terms of transfer medium conveyance direction R4. Next, the mechanism of the prevention of the soiling of the second transfer roller 6 by the charging member 30 in the borderless printing mode will be described with reference to FIG. 5.

The toner image T on the intermediary transfer belt 1 is conveyed by the movement of the intermediary transfer belt 1, in the direction R3 indicated by an arrow mark in the drawing. As soon as the toner image T on the intermediary transfer belt 1 is moved past the auxiliary roller 4, it begins to be moved toward the second transfer nip N2 along the transfer medium P which is being conveyed in the direction R4 indicated by the arrow mark.

As the toner image T on the intermediary transfer belt 1 arrives at the position in which it faces the charging member 30, it is charged by the charging member 30, to which voltage opposite in polarity to the normal toner voltage is being applied. More specifically, electrical discharge is induced between the charging member 30 and intermediary transfer belt 1 by the pre-second transfer voltage applied to the charging member 30. In terms of positive polarity, the charging member 30 is higher in potential. Thus, the positive charge generated by the electrical discharge moves toward the intermediary transfer belt 1.

However, because of the presence of the transfer medium P between the charging member 30 and the intermediary transfer belt 1, the portion of the toner image T, which is on the area N of the intermediary transfer belt 1, that is, the portion of the toner image T, which is going to be transferred (second transfer) onto the transfer medium P, is not affected by the positive charge generated by the electrical discharge. Therefore, this portion of the toner image T remains negative in polarity. The back surface of the transfer medium P is charged by the charging member 30 to the positive polarity, which is the opposite polarity to the polarity of the toner image T.

On the other hand, when the image forming apparatus 100 is operated in the borderless printing mode, a toner image which is larger than the transfer medium P is formed. Thus, the portion of the toner image T, which were transferred onto the areas D of the intermediary transfer belt 1, that is, the portion of the toner image T, which will extend beyond the edges of the transfer medium P as it is transferred onto the transfer medium P, is affected by the positive charge generated by the electrical discharge. That is, it is reversed in polarity; it becomes positively charged. The hatched areas in FIG. 5 correspond to the portions of the toner image T, which are on the area D of the intermediary transfer belt 1 and were reversed in polarity by the charging member 30.

In the position in which the transfer medium P and intermediary transfer belt 1 face the charging member 30, the distance between the transfer medium P and intermediary transfer belt 1 is very close (roughly 1-2 mm). Therefore, the presence of the transfer medium P between the charging member 30 and the intermediary transfer belt 1 can be used to precisely charge only the portions of the toner image T, which will extend beyond the edges of the transfer medium P as they are moved through the second transfer nip N2.

Thereafter, the toner image T is moved by the movement of the intermediary transfer belt 1 into the second transfer nip N2, in which positive voltage is applied to the transfer medium P from the second transfer roller 6. The portions of the toner image T, which correspond in position to the area D, have just been positively charged, and therefore, are subjected to the coulometric force which repels the second transfer roller 6 to which positive voltage is being applied. Therefore the portions of the toner image T, which correspond in position to the area D, are not transferred onto the second transfer roller 6; they remain on the intermediary transfer belt 1. On the other hand, the portion of the toner image T, which corresponds in position to the area N, remained the same in polarity (negatively charged). Therefore, it is normally transferred (second transfer) onto the transfer medium P. The back surface of the transfer medium P is positive in polarity because it was positively charged by the charging member 30. This charge on the back surface of the transfer medium P simply generates coulometric force which works in the direction to attract the toner image T to the transfer medium P. Therefore, it does not interfere with the second transfer of the toner image T.

As described above, the charging member 30 is positioned immediately upstream of the second transfer nip N2 in such a position that the transfer medium P and the toner image T on the intermediary transfer belt 1 simultaneously pass above the charging member 30. Because the charging member 30 is in the above described position, it can charge the portions of the toner image T, which correspond in position to the area D, that is, the portions of the toner image T, which will be beyond the edges of the transfer medium P in the second transfer nip N2, to the opposite polarity to the normal toner polarity, when the image forming apparatus 100 is in the borderless printing mode. Since they are reversed in polarity, they do not adhere to the second transfer roller 6.

In this embodiment, the charging member 30 is positioned in consideration of the actual position in which the transfer medium P will be immediately before the transfer medium P enters the second transfer nip N2. Therefore, even if the toner image on the intermediary transfer belt 1 and the transfer medium P become slight misaligned, it is always possible to charge only the portions of the toner image T, which will be beyond the edges of the transfer medium P in the second transfer nip N2, to the polarity which is opposite to the normal polarity of the toner image T.

In other words, the problem that when an image forming apparatus is in the borderless printing mode, the back surface of the transfer medium P is soiled, can be reliably prevented with the employment of a relatively simple structural arrangement.

7. Results of Verification

Next, the results of the verification of the effects of this embodiment will be described.

A substantial number of copies were continuously outputted with the use of the image forming apparatus 100 in this embodiment, which was in the borderless printing mode.

Then, the copies were examined for the extent of soiling on their back surface, and also, for the presence of image defects on the top surface of the transfer medium P. More specifically, the image forming apparatus 100 was operated in an environment which was 25° C. in temperature and 50% in relative humidity. The voltage to be applied to the charging member 30 was varied in magnitude to vary the amount of electric current to be supplied to the charging member 30. The transfer mediums P used for the evaluation of this embodiment was "blank white index cards" (sold by Office Depot, Inc.,), which were 10.2 cm (4 inches) in width (direction roughly perpendicular to transfer medium conveyance direction), 15.2 cm (6 inches) in length (direction parallel to transfer medium conveyance direction).

In order to confirm the effects of this embodiment, yellow, cyan, magenta, and black monochromatic images, which were 70% in density were layered to form a solid image, which was 300% in density, on each transfer medium P. The image forming apparatus 100 was operated in the borderless printing mode. The toner images formed on the intermediary transfer belt 1 for the evaluation was 10.6 cm in width (direction roughly perpendicular to transfer medium conveyance direction), and 15.6 cm in length (direction parallel to transfer medium conveyance direction). That is, the toner image formed on the intermediary transfer belt 1 was large enough to extend by 0.2 from the leading, trailing, left, and right edges of the transfer medium P if the center of the toner image T were aligned with the center of the transfer medium P. The process speed was 40 mm/sec.

The results are shown in Table 1.

TABLE 1

| | | Embodiment 1 | | Prior Art | |
|---|---|---|---|---|---|
| Applied Voltage kV | Supplied Current micro A | Back Side Soiling Prevent'n | End Image Missing Prevent'n | Back Side Soiling Prevent'n | End Image Missing Prevent'n |
| 0.00 | 0.0 | NG | G | NG | G |
| 3.50 | 12.5 | NG | G | — | — |
| 3.65 | 15.0 | NG | G | — | — |
| 3.75 | 17.5 | G | G | — | — |
| 3.85 | 20.0 | G | G | — | — |
| 3.95 | 22.5 | G | NG | — | — |
| 4.10 | 25.0 | G | NG | — | — |

"G" in the table stands for acceptable level, that is, non-problematic level.
"NG" stands for no good level, that is, an unacceptable level.

For the comparison of the image forming apparatus 100 in this embodiment with conventional image forming apparatuses, the test results of an example of a conventional image forming apparatus which does not have the charging member 30 are given in the column for the conventional image forming apparatus. The example of a conventional image forming apparatus is the same in structure as the image forming apparatus 100 in this embodiment, except that the former is not provided with the charging member 30.

As for the back soiling of the transfer medium P, the higher the voltage applied to the charging member 30, the less the back soiling. It was confirmed that when the voltage applied to the charging member 30 was no less than 3.75 kV, and the amount of electric current supplied to the charging member 30 was no less than 17.5 μA, the back soiling was nonproblematic in practical terms.

Figure 6:
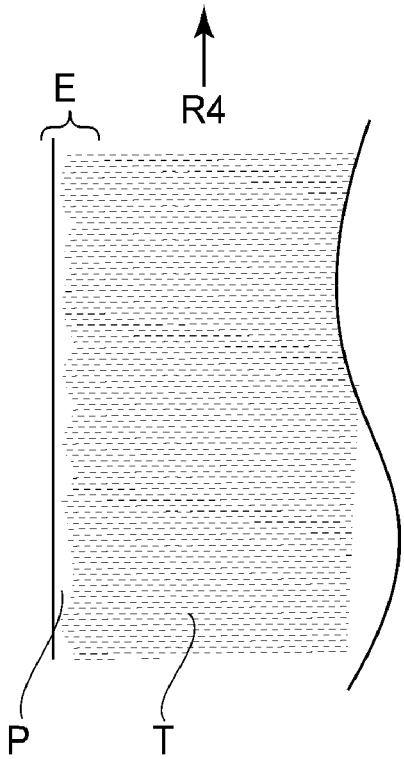
FIG. 6 is a schematic drawing of an example of borderless copy, the edge portions of which are not covered with the image.

On the other hand, it was found that when the voltage applied to the charging member 30 was higher than a certain level, the image forming apparatus 100 was likely to output images, the left- and right-hand edge portions, in terms of the transfer medium conveyance direction R4, of which were missing. In this specification, the image defect of this type, hereafter, will be referred to as "missing edges". FIG. 6 is a schematic drawing of a toner image with the "missing edges". As is evident from the drawing, the "missing edges" in the area E of the drawing are attributable to the phenomenon that the portions of the toner image T on the intermediary transfer belt 1, which were to cover the transfer medium P, from the edges of the transfer medium P up to several millimeters from the edges, were not transferred onto the transfer medium P, and remain on the intermediary transfer belt 1. It was discovered that in the case of the image forming apparatus 100 in this embodiment, this phenomenon occurred when the voltage applied to the charging member 30 was no less than 3.95 kV, and the amount of electric current supplied to the charging member 30 was no less than 22.5 μA. The cause of the "missing edges" seems to be the following. That is, if the voltage applied to the charging member 30 is higher than a certain level, the positive electric charge generated by electrical discharge enters the gap between the intermediary transfer belt 1 and the edge portions of the transfer medium P, whereby the portions of the toner image T, which are in the adjacencies of the edges of the transfer medium P were reversed in polarity.

As described above, in the case of the image forming apparatus 100 in this embodiment, if the voltage to be applied to the charging member 30 is set higher than a certain level, the prevention of the "back soiling" is traded off by the "missing edges". In this embodiment, both the prevention of the "back soiling" and the prevention of the "missing edges" can be achieved by setting the voltage to be applied to the charging member 30 to a value in a range which is no less than 3.75 kV and no more than 3.9 kV.

Embodiment 2

Next, another embodiment of the present invention will be described. The basic structure of the image forming apparatus in this embodiment is the same as that of the image forming apparatus 100 in the first embodiment. Thus, the components, members, parts, etc., of the image forming apparatus in this embodiment, which are the same in function and structure as the counterparts in the first embodiment will be given the same referential codes as those given to the counterparts, one for one, and will not be described here.

Figure 7:
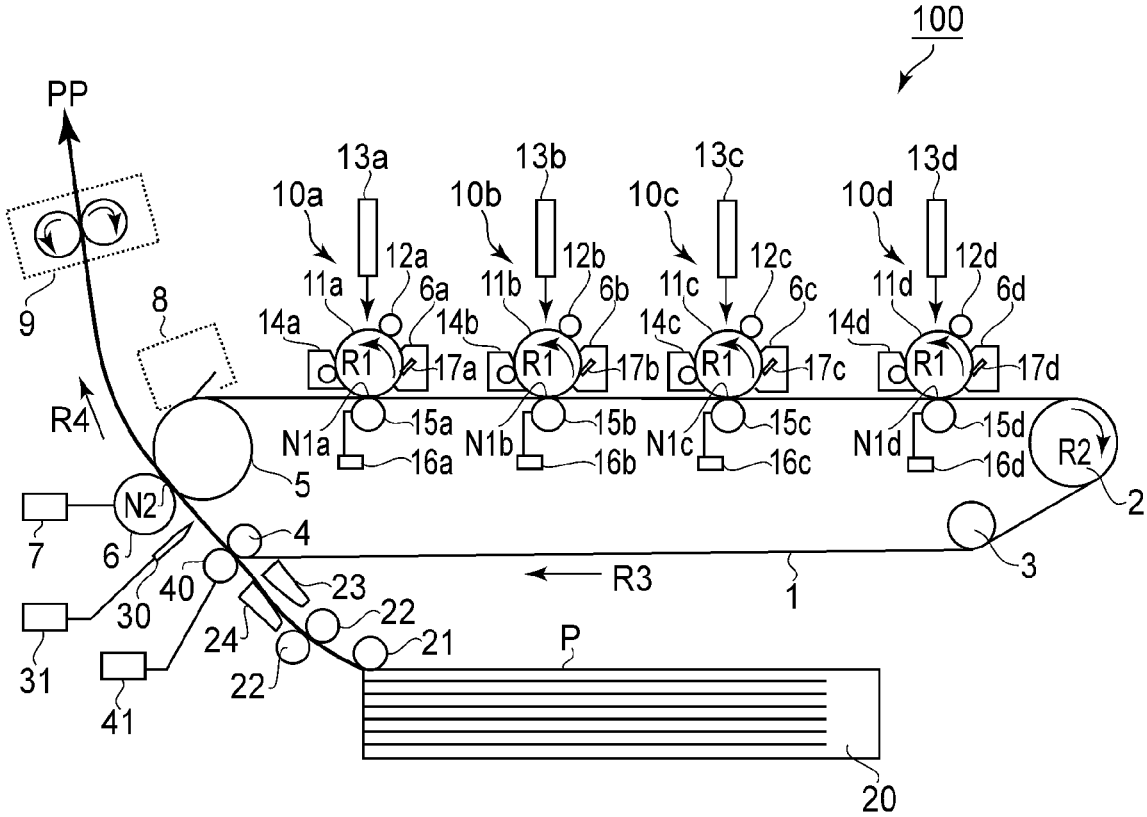
FIG. 7 is a vertical sectional view of the image forming apparatus in the second preferred embodiment of the present invention, and shows the structure thereof.

FIG. 7 is a vertical sectional view of the image forming apparatus in this embodiment of the present invention, and shows the structure of the apparatus. This image forming apparatus is different from the one in the first embodiment in that it has an adhesion roller 40 as a member for electrostatically adhering the transfer medium P to the intermediary transfer belt 1 before the transfer medium P enters the second transfer nip N2. Thus, in the case of this image forming apparatus 100, the transfer medium P is electrostatically adhered to the intermediary transfer belt 1 before it enters the second transfer nip N2. Therefore, the portions of the toner image T, which will be beyond the boundary of the transfer medium P in the second transfer nip N2, are charged while the transfer medium P and intermediary transfer belt 1 are in contact with each other with the presence of virtually no gap between the two.

The adhesion roller 40 is positioned so that it opposes the auxiliary roller 4 with the presence of the intermediary transfer belt 1 between the two rollers 40 and 4. It is kept pressed against the auxiliary roller 4 with the presence of the intermediary transfer belt 1 between the two rollers 40 and 4. The adhesion roller 40 plays the role of electrostatically adhering the transfer medium P to the intermediary transfer belt 1. The adhesion roller 40 is in connection with an electric power source 41 as a voltage applying means for applying to the adhesion roller 40 the voltage for adhering the transfer medium P to the intermediary transfer belt 1. To the adhesion roller 40, an adhesion voltage which is variable in magnitude is applied from the electric power source 41. As for the polarity of the adhesion voltage, it has to be the same as that of the toner. That is, for the purpose of electrostatically attracting the transfer medium P to the intermediary transfer belt 1, the polarity of the adhesion voltage does not matter. In this embodiment, however, the adhesion roller 40 comes into contact with the toner image on the intermediary transfer belt 1 to generate coulometric force, in order to electrostatically prevent the adhesion roller 40 from being soiled. Thus, the polarity of the adhesion voltage has to be the same as that of the toner voltage. In this embodiment, the toner was negatively charged, and therefore, the adhesion voltage was also negative in polarity.

The adhesion roller 40 is made up of a metallic core, and a solid rubber layer with which the metallic core is covered. It is to the metallic core that the adhesion voltage is applied. In this embodiment, a rubber roller made by covering the peripheral surface of a metallic core with EPDD rubber, in which carbon black particles were dispersed to adjust the rubber in electrical resistance, was used as the adhesion roller 40. The adhesion roller 40 was 12 mm in external diameter. The electrical resistance of the adhesion roller 40 was measured by wrapping a piece of metallic foil, which was 1 cm in width, around the adhesion roller 40, and applying 500 V of voltage between the metallic foil and the metallic core. The electrical resistance of the adhesion roller 40 measured with the use of the above-described method was $10^7$ Ω·m.

Next, the image forming operation carried out in the borderless printing mode by the image forming apparatus 100 in this embodiment will be described. The sequential operational steps of charging, exposing, developing, and first transfer carried out in this embodiment are the same as those in the first embodiment, and therefore, will not be described here.

After being conveyed from the transfer medium cassette 20 by the feed roller 21 and the pair of registration rollers 22, the transfer medium P is guided by the top and bottom guides 23 and 24, into the nip between the adhesion roller 40 and intermediary transfer belt 1. The transfer medium P is pinched by the adhesion roller 40 and intermediary transfer belt 1, being thereby pressed upon the outward surface of the intermediary transfer belt 1, while voltage is applied between the intermediary transfer belt 1 and adhesion roller 40. Thus, the transfer medium P is electrostatically adhered to the outward surface of the intermediary transfer belt 1. During this process, negative adhesion voltage is applied to the transfer medium P from the adhesion roller 40, ensuring that the transfer medium P is adhered to the intermediary transfer belt 1, and then, is conveyed to the second transfer nip N2 in the transfer medium conveyance direction R4 while remaining adhered to the intermediary transfer belt 1 with the presence of virtually no gap between the transfer medium P and intermediary transfer belt 1.

As described above, in this embodiment, the transfer medium P comes into contact with the intermediary transfer belt 1 on the upstream side of the second transfer nip N2 in terms of the transfer medium conveyance direction, and is conveyed past the charging member 30, remaining in contact with the intermediary transfer belt 1 with the presence of virtually no gap between the transfer medium P and intermediary transfer belt 1.

Figure 8:
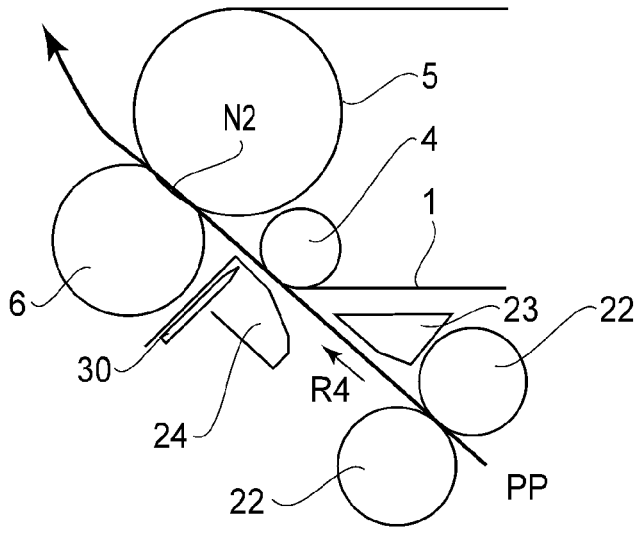
FIG. 8 is vertical sectional view of the second transfer nip, and its adjacencies, of the image forming apparatus in the second embodiment, and shows the structure of the second transfer nip and its adjacencies.

Also in this embodiment, the portions of the toner image on the intermediary transfer belt 1, which are outside the boundary of the transfer medium P, and the back surface of the transfer medium P, are positively charged by the charging member 30 as they are in the first embodiment. In this embodiment, however, the transfer medium P and intermediary transfer belt 1 are kept electrostatically adhered to each other, and therefore, there is virtually no gap between the two. Therefore, it is difficult for the positive ions generated by the charging member 30 to enter between the transfer medium P and intermediary transfer belt 1, making it unlikely for the portion of the toner image, which are to be transferred onto the transfer medium P, to be reversed in polarity. Therefore, an image with the "missing edges", which was outputted by the image forming apparatus 100 in the first embodiment when the voltage applied to reverse in polarity the portions of the toner image, which were outside the boundary of the transfer medium P, was set higher than a certain level, is unlikely to be outputted. Therefore, the voltage to be applied to the charging member 30 can be widened in the range in which images with defects is unlikely to be outputted. In other words, this embodiment can better ensure that an image forming apparatus does not output images with "missing edges" when it is operated in the borderless mode. As another countermeasure for the "missing edges", it is effective to structure an image forming apparatus as shown in FIG. 8. The image forming apparatus shown in FIG. 8 is structured so that while the transfer medium P is conveyed toward the second transfer nip N2, it is made to come into contact with the intermediary transfer belt 1, on the upstream side of the second transfer nip N2, without the employment of the adhesion roller 40. This structural arrangement also can keep the transfer medium P and intermediary transfer belt 1 electrostatically adhere to each other, and therefore, there will be no gap between the transfer medium P and intermediary transfer belt 1 in macroscopic terms immediately before the transfer medium P enters the second transfer nip N2. Therefore, it is difficult for the positive charge generated by the charging member 30 to enter between the transfer medium P and intermediary transfer belt 1, and therefore, it is unlikely for the portion of the toner image T, which are to be transferred onto the transfer medium P, to be reversed in polarity.

However, unlike the structural arrangement shown in FIG. 7, the structural arrangement shown in FIG. 8 does not employ the adhesion roller 40. Therefore, in the case of the structural arrangement shown in FIG. 8, it is necessary for the speed with which the transfer medium P is conveyed to the second transfer nip N2, and the speed with which a given point of the intermediary transfer belt 1 is moved toward the second transfer nip N2, to be precisely matched until the transfer medium P reaches the second transfer nip N2.

Next, the results of the verification of the effects of this embodiment will be described.

A substantial number of copies were continuously outputted in the borderless printing mode, with the use of the image forming apparatus 100 in this embodiment. Then, the copies were evaluated using the same standard as those used to evaluate the copies made with the use of the image forming apparatus in the first embodiment.

The results are shown in Table 2.

TABLE 2

| | | Embodiment 2 | | Embodiment 1 | |
|---|---|---|---|---|---|
| Applied Voltage kV | Supplied Current micro A | Back Side Soiling Prevent'n | End Image Missing Prevent'n | Back Side Soiling Prevent'n | End Image Missing Prevent'n |
| 0.00 | 0.0 | NG | G | NG | G |
| 3.50 | 12.5 | NG | G | NG | G |
| 3.65 | 15.0 | NG | G | NG | G |
| 3.75 | 17.5 | G | G | G | G |
| 3.85 | 20.0 | G | G | G | G |

TABLE 2-continued

| | | Embodiment 2 | | Embodiment 1 | |
|---|---|---|---|---|---|
| Applied Voltage kV | Supplied Current micro A | Back Side Soiling Prevent'n | End Image Missing Prevent'n | Back Side Soiling Prevent'n | End Image Missing Prevent'n |
| 3.95 | 22.5 | G | G | G | NG |
| 4.10 | 25.0 | G | G | G | NG |

"G" in the table stands for acceptable level, that is, non-problematic level.
"NG" stands for no good level, that is, an unacceptable level.

For the comparison of the image forming apparatus 100 in this embodiment with the image forming apparatus in the first embodiment, the test results of the image forming apparatus in the first embodiment also are shown.

As far as the "back soiling" of the transfer medium P is concerned, there is not difference between the structural arrangement in this embodiment and that in the first embodiment. That is, the higher the voltage applied to the charging member 30, the less the "back soiling". It was confirmed that when the voltage applied to the charging member 30 was no less than 3.75 kV, and the amount of electric current supplied to the charging member 30 was no less than 17.5 μA, the "back soiling" was nonproblematic in practical terms.

As for the "missing edges", in the case of the structural arrangement in the first embodiment, it occurred when the voltage applied to the charging member 30 was no less than 3.95 kV. In the case of the structural arrangement in this embodiment, however, it did not occur even when 4.1 kV of voltage, which was highest among the voltages applied for the evaluation, was applied to the charging member 30.

As will be evident from the description of this embodiment given above, the image forming apparatus in this embodiment was wider than that in the first embodiment, in the range of the voltage which can be applied to the charging member 30 to prevent the "back soiling" without resulting in the formation of images with the "missing edges". In other words, in terms of the level of reliability with which borderless images with no "missing edges" are outputted, the image forming apparatus in this embodiment is superior to that in the first embodiment.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 182918/2009 filed Aug. 5, 2009 which is hereby incorporated by reference.

What is claimed is:

1. An image forming apparatus, comprising:

an image bearing member for carrying a toner image;

a transfer member forming a nip with said image bearing member to transfer the toner image from said image bearing member onto a transfer material at said nip; and a charging member for effecting electric discharge toward said image bearing member, said charging member being disposed at such a position as is opposed to a side of the transfer material which receives the toner image, and on an upstream side of said nip with respect to a feeding direction of the transfer material, wherein said image forming apparatus is operable in a marginless printing mode in which the toner image formed on said image bearing member is larger than a size of the transfer material, and the toner image is transferred as far as edges of the transfer material, and wherein when said image forming apparatus operates in the marginless printing mode, said charging member effects the electric discharge toward the toner existing in an area of the image bearing member which corresponds to an area which is outside the edge of the transfer material at the nip to electrically charge the toner in the outside area to a polarity opposite a regular polarity.

2. An image forming apparatus according to claim 1, wherein the transfer material contacts said image bearing member at a position upstream of said nip with respect to the feeding direction, and in a state of contacting said image bearing member, the transfer material passes through a position where it opposes said charging member.

3. An image forming apparatus according to claim 1, further comprising an electrostatic attraction member for electrostatically attracting the transfer material to said image bearing member prior to passing through said nip.

4. An image forming apparatus according to claim 1, wherein said image forming apparatus is operable in a print mode for forming the toner image on the transfer material with margins at respective edges of the transfer material.

5. An image forming apparatus according to claim 1, wherein when said image forming apparatus operates in the marginless printing mode, said charging member is operated, and when said image forming apparatus operates in the print mode for forming the toner image on the transfer material with the margins, said charging member is not operated.

* * * * *